US005786793A

United States Patent [19]

Maeda et al.

[11] Patent Number: 5,786,793

[45] Date of Patent: Jul. 28, 1998

[54] COMPACT ANTENNA FOR CIRCULAR POLARIZATION

[75] Inventors: Shuji Maeda, Osaka; Tsutomu Kobayashi, Kyoto; Munehiko Itoh, Osaka, all of Japan; Raj Mittra, Urbana, Ill.; Ikmo Park, Kwanchun, Rep. of Korea; Supriyo Dey, Champaign, Ill.

[73] Assignee: Matsushita Electric Works, Ltd., Osaka, Japan

[21] Appl. No.: 908,723

[22] Filed: Aug. 8, 1997

Related U.S. Application Data

[63] Continuation of Ser. No. 614,650, Mar. 13, 1996, abandoned.

[51] Int. Cl.[6] ..... H01Q 1/38; H01Q 21/26

[52] U.S. Cl. ..... 343/700 MS; 343/846; 343/853

[58] Field of Search ..... 343/700 MS, 829, 343/846, 853; H01Q 1/38, 21/24, 21/26

[56] References Cited

U.S. PATENT DOCUMENTS

| | | | |
|---|---|---|---|
| 4,973,972 | 11/1990 | Huang | 343/700 MS |
| 5,173,711 | 12/1992 | Takeuchi et al. | 343/700 MS |
| 5,406,292 | 4/1995 | Schnetzer et al. | 343/700 MS |

FOREIGN PATENT DOCUMENTS

| | | | |
|---|---|---|---|
| 2147747 | 5/1985 | United Kingdom | 343/700 MS |

*Primary Examiner*—Michael C. Wimer

*Attorney, Agent, or Firm*—Armstrong, Westerman, Hattori, McLeland & Naughton

[57] ABSTRACT

A compact antenna for circular polarization comprises a substrate of a dielectric material which is formed on its bottom surface with a ground plane and on its top surface with four planar rectangular patches of an electrically conductive material. The four patches are mounted in a coplanar relation on the top surface of the substrate, and arranged along four sides of a square pattern with the length of each patch angled at 90° with respect to the length of the two adjacent patches. Each of the four patches is short-circuited to the ground plane at a shorting point located at a corner of the square pattern. A 90° hybrid circuit is connected to directly feed only the two adjacent patches with a phase difference of 90° to thereby define these two patches as active antenna elements which are fed with 0° and 90° signals, respectively. The other two adjacent patches are not fed from the hybrid circuit to define parasitic antenna elements each coupled with the adjacent active antenna element to provide a signal which is 90° out of phase with a signal on the adjacent active antenna element. Thus, the active and parasitic antenna elements arranged in one direction around the substrate are fed at 0°, 90°, 180°, and 270° phases for circular polarization only with the use of a single hybrid circuit.

7 Claims, 9 Drawing Sheets

COMPACT ANTENNA FOR CIRCULAR POLARIZATION

This application is a Continuation of application Ser. No. 08/614,650 filed Mar. 13, 1996, now abandoned.

BACKGROUND ART

1. Field of the Invention

The present invention is directed to a compact antenna for transmitting and receiving circular polarization which may be used in a mobile voice and data communication system.

2. Description of the Prior Art

A prior circular polarization antenna has been proposed to comprise four short-circuited patches arranged in two arrays on a square substrate of a dielectric material in an attempt to reduce the planar dimension of the antenna. The four patches are fed with a 90° phase difference between the two adjacent patches to achieve circular polarization. This antenna requires a complicated feed circuit of achieving 4-point feed with 0°, 90°, 180°, and 270° phases to the individual patches. Due to the complicate feed circuit, the antenna of this type is found to be impractical. In order to overcome this shortcoming, another circular polarization antenna is proposed in U.S. Pat. No. 5,406,292 to comprise four patches arranged in two arrays. Two adjacent first and second patches are connected respectively to first and second microstrip feed lines so as to be directly fed thereby with a 90° phase difference. The first and second feed lines also extends beyond and above the remaining two adjacent third and fourth patches in such a manner that the third and fourth patches act as local ground planes respectively for the first and second microstrip feed lines, thereby providing a 180° out of phase signal in each of the third and fourth patches relative to the first and second microstrip feed lines. Although this antenna requires only a single 90° hybrid circuit to achieve circular polarization, a complicated structure is required to route the first and second feed lines to the first and second patches while making couplings with the third and fourth patches for accomplishing a 180° out of phase relation between the signals on the microstrip feed lines and the third and fourth patches. Particularly, the first and second patches cannot made be coplanar since the connection between the first feed line and the first patch cannot be crossed with the same plane with the connection between the second feed line and the second patch. Due to this complexity in structure, the antenna is not suited for low cost fabrication and therefore not practical for a large scale production.

SUMMARY OF THE INVENTION

The above problem and insufficiency have been eliminated in the present invention which provides an improved compact antenna for circular polarization. The compact antenna for circular polarization comprises a substrate made of a dielectric material and having top and bottom surfaces, a ground plane on the bottom surface of the substrate, and four planar and rectangular patches made of an electrically conductive material and defined as first, second, third and fourth patches. The patches are mounted in a coplanar relation on the top surface of the substrate. The four patches are arranged in a square pattern such that a longitudinal axis of the first patch extends parallel to that of the third patch and perpendicularly to that of each of the second and fourth patches, and that each of the patches is spaced from two adjacent patches by a distance. Each of four sides of the square pattern is equal to the sum of the distance, length and width of the rectangular patch. Each of the four patches is short-circuited to the ground plane at a shorting point located at a corner of the patch by the use of a shorting member. A feed structure is provided to directly feed each of the first and second patches at a feed point located around the shorting point to thereby define the first and second patches as active antenna elements and define the third and fourth patches as parasitic antenna elements. The feed structure comprises a 90° hybrid circuit provides a first signal to the first patch and a second signal which is 90° out of phase with the first signal to the second patch, and two feed lines extending from the 90° hybrid circuit to the feed point of each of the active antenna elements through the substrate without interfering with the parasitic antenna elements. The parasitic antenna elements are electromagnetically excited by the active antenna elements fed with the first and second signals to develop third and fourth signals which are cooperative with the first and second signals to achieve circular polarization. The third patch provides the third signal which is 180° out of phase with the first signal. The fourth patch provides the fourth signal which is 270° out of phase with the first signal. In the present invention, since all the patches can be mounted in the coplanar relation on the top surface of the substrate in the circular polarization antenna operated by using only one 90° hybrid circuit, directly feeding only two active antenna elements, and electromagnetically exciting the parasitic antenna elements by the fed active antenna elements, it is possible to reduce the complexity of the feed network. This advantage will bring low cost fabrication and large scale production of the antenna. In addition, the present antenna can provide the following important characteristics:

(1) The present antenna is a compact and simple structure compared to available antennas for circular polarization of the prior art;

(2) The antenna can provide a large axial ratio bandwidth (axial ratio <2); and (3) The antenna demonstrates good circular polarization performance over a wide angular range in both azimuth and elevation planes.

Accordingly, it is a primary object of the present invention to provide a compact antenna for circular polarization which is simple in design but gives sufficient circular polarization performance for use in a mobile voice and data communication system.

It is preferred from the viewpoint of reduction of antenna size that the length of each of the patches is less than a quarter of the wavelength of a resonant frequency of the antenna. Owing to a wavelength reduction effect by using a dielectric substrate with a high dielectric constant, and an inductance loading effect by using a conducting pin or a through hole with a fine diameter at the shorting point, physical size of the patch, i.e., the length of the patch can be determined to be sufficiently shorter than the quarter of the wavelength.

In a preferred embodiment of the present invention, the shorting points of the patches are located at four corners of the square pattern.

In a further preferred embodiment, each of the patches is formed in at least one of two opposed sides with at least one slit so as to define a meander line along which a signal propagates. This meander line gives an effective antenna length of the patch which is greater than the actual length of the patch. Consequently, the length of the patch can be reduced while maintaining the effective antenna length suited for a desired operating frequency.

It is therefore another object of the present invention to provide a compact antenna for circular polarization which can be made to have a reduced planar dimensions.

In another preferred embodiment, the 90° hybrid circuit is a simplified coplanar 90° phase-shift circuit which is formed on the bottom surface of the substrate. The phase-shift circuit comprises first and second strip lines extending from a common feed terminal, which is formed on the bottom surface in a coplanar relation to the ground plane, respectively to first and second feed terminals on the bottom surface of the substrate below the active antenna elements. The first and second feed terminals are connected respectively to the feed points on the active antenna elements through the feed lines. A length of the first strip line differs from that of the second strip line by an amount to provide a 90° phase difference between the first and second signals.

The patches and the ground plane can be made respectively by etching conductive layers on opposite surfaces of the substrate. Thus, the antenna can be easily obtained by the use of a printed board manufacturing technology, which is therefore a further object of the present invention.

These and still other objects and advantages will become apparent from the following description of the preferred embodiments of the invention when taken in conjunction with the attached drawings.

DESCRIPTION OF THE PREFERRED EMBODIMENTS

First Embodiment

Figure 1:
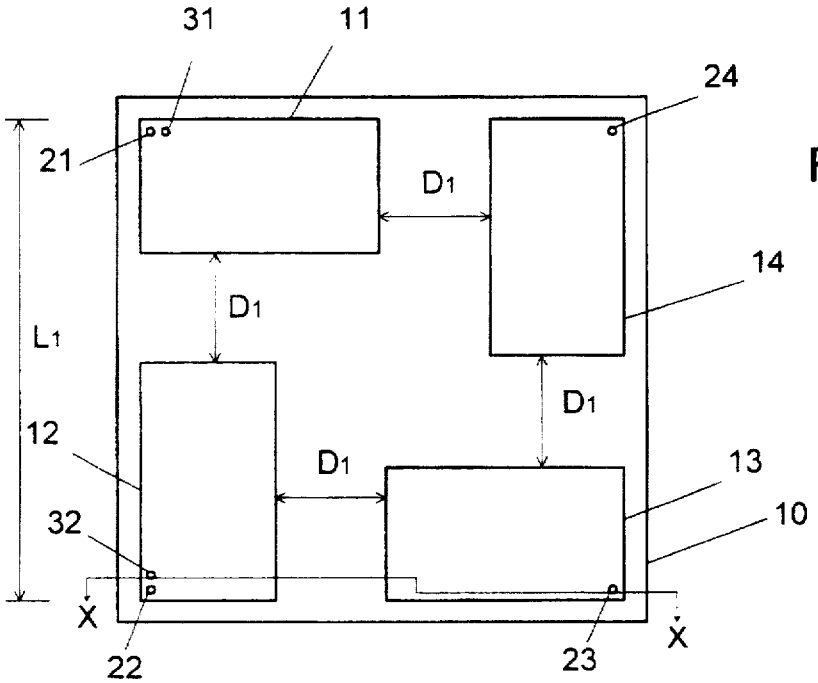
FIG. 1 is a top view of a compact antenna for circular polarization in accordance with a first embodiment of the present invention.
Figure 2:
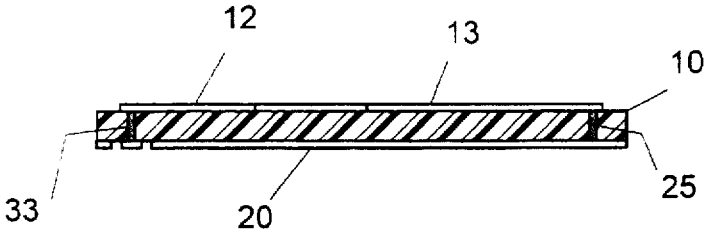
FIG. 2 is a cross sectional view taken along line X—X of FIG. 1.

Referring now to FIG. 1, there is illustrated a compact antenna for circular polarization designed for use at an operating frequency of 929 MHz in accordance with a first embodiment of the present invention. The compact antenna comprises a square substrate 10 made of a dielectric material, and four planar, rectangular, and substantially equal sized patches made of an electrically conductive material. In this embodiment, the substrate 10 is made of a polyfuluoroethylene resin having a dielectric constant of 2.6 and has dimensions of 3.2 mm×65 mm×65 mm. In place of the polytetrafluoroethylene resin, for example, polyphenylene resin having a dielectric constant of about 3.5, epoxy resin having a dielectric constant of about 4.3, or a ceramic having a dielectric constant of about 10 may be selected. The square substrate 10 has top and bottom surfaces. A ground plane 20 is formed on the entire bottom surface of the square substrate 10, as shown in FIG. 2. The patches consists of first patch 11, second patch 12, third patch 13, and fourth patch 14, and are mounted in a coplanar relation on the top surface of the square substrate 10. The substrate is prepared in the form of a double-sided printed board from which the patches (11–14) and ground plane 20 are formed respectively by etching metallized conductive layers such as copper or aluminum on opposite surfaces of the printed board.

In this embodiment, each of the patches (11–14) is dimensioned to have a 32 mm length and a 18 mm width. The 32 mm length of the patch corresponds to about $\lambda/10.1$ in the free space ($\lambda$=wave length of the 929 MHz signal). The four patches (11–14) are arranged in a square pattern such that a longitudinal axis of the first patch 11 extends parallel to that of the third patch 13 and perpendicularly to that of each of the second patch 12 and fourth patch 14, and that each of the patches is separated from two adjacent patches by a distance D1 which is 15 mm in this embodiment. Each of four sides L1 of the square pattern is equal to the sum of the distance D1, the length and width of the patch. In this embodiment, the length L1 of the square pattern is 65 mm. The patches (11–14) are short-circuited to the ground plane 20 at shorting points (21–24) located at the four corners of the square pattern by means of a shorting conductor 25 in the form of a via hole or a pin inserted in a through-hole of the substrate 10, as shown in FIG. 2.

Figure 3:
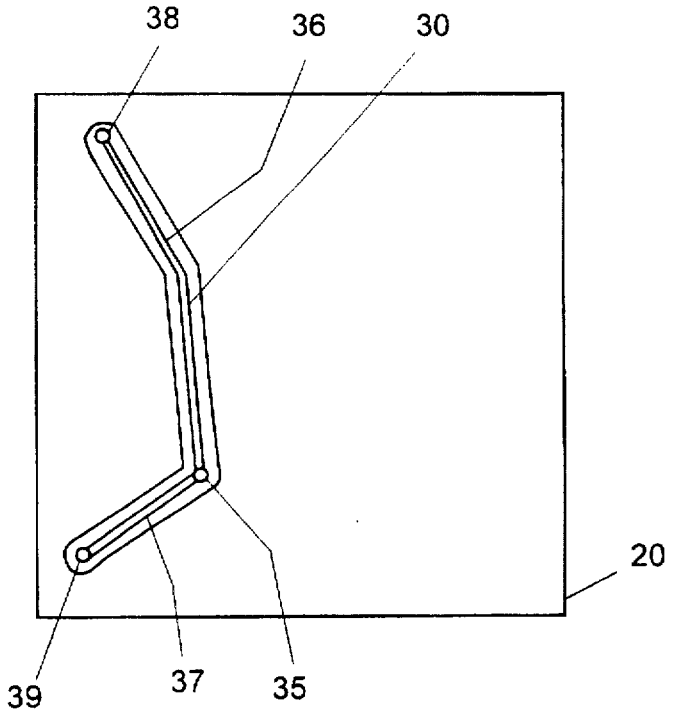
FIG. 3 is a bottom view of the antenna.

Only the first and second patches 11 and 12 are connected to a 90° hybrid circuit (not shown) or simplified coplanar 90° phase-shift circuit 30, as shown in FIG. 3, to be directly fed at their respective feed points 31 and 32 located around the shorting points 21 and 22 by means of a feed conductor 33 in the form of a via hole or a pin inserted in a through hole of the substrate 10, as shown in FIG. 2. Therefore, the first and second patches 11 and 12 act as active antenna elements, while the third and fourth patches 13 and 14 act as parasitic antenna elements. The parasitic antenna elements can be electromagnetically coupled with the active antenna elements without physical contacts therebetween. Due to considerably less diameter (about 0.5 mm) of the shorting conductor 25 relative to the width of the patch, the active antenna element is of a base-loaded antenna element. The base-loading effect is cooperative with the use of high dielectric constant material as the substrate to shorten the length of the patch to 32 mm which is considerably below $\lambda/4$ ($\cong$80 mm) at the operating frequency, thereby greatly reducing the planar dimensions of the antenna.

As shown in FIG. 3, the phase-shift circuit 30 comprises two feed lines 36 and 37 extending from a common 50 Ω coaxial connector 35 respectively to the feed points 31 and 32 of the first and second patches 11 and 12 through the substrate 10 without interfering with the parasitic antenna elements. The feed lines 36 and 37 are formed to form 100 Ω characteristic impedance by etching the conductive layer on the bottom of the substrate 10 to be coplanar with the ground plane 20. The feed lines 36 and 37 has different line lengths extending from the common 50 Ω coaxial connector 35 to the individual feed terminals 38 and 39 from which the feed conductors 33 extend upright to the feed points 31 and 32 on the first and second patches 11 and 12.

The phase-shift circuit 30 provides a first signal to the first patch 11 and a second signal, which is 90° out of phase and equal in amplitude with the first signal, to the second patch 12. In other words, the first and second patches are fed with equal amplitudes but with 90° of phase difference. The two feed lines 36 and 37 are selected to have such length as to provide the first and second signals. The parasitic antenna elements are electromagnetically excited by the active antenna elements fed with the first and second signals to develop third and fourth signals which are cooperative with the first and second signals to achieve circular polarization. The third patch provides the third signal which is 180° out of phase with the first signal. The fourth patch provides the fourth signal which is 270° out of phase with the first signal. In other words, each of the active antenna elements is electromagnetically coupled to the adjacent parasitic antenna element. When the first signal is fed to the first patch 11, the fourth signal is induced on the fourth patch 14. On the other hand, when the second signal is fed to the second patch 12, the third signal is induced on the third patch 13. As a result, in this embodiment, the first signal (0°), second signal (90°), third signal (180°), and fourth signal (270°) are developed respectively on the first to fourth patches 11 to 14 to achieve circular polarization. The circular symmetry of the four patches of the present invention can provide broad radiation directivity sufficient for use in a mobile communication system where the antenna is frequently required to change its orientation. In the above, a transmitting operation of circular polarization from the present antenna is explained, although, it is needless to say that the present antenna can be used to receive circular polarization.

Figure 4:
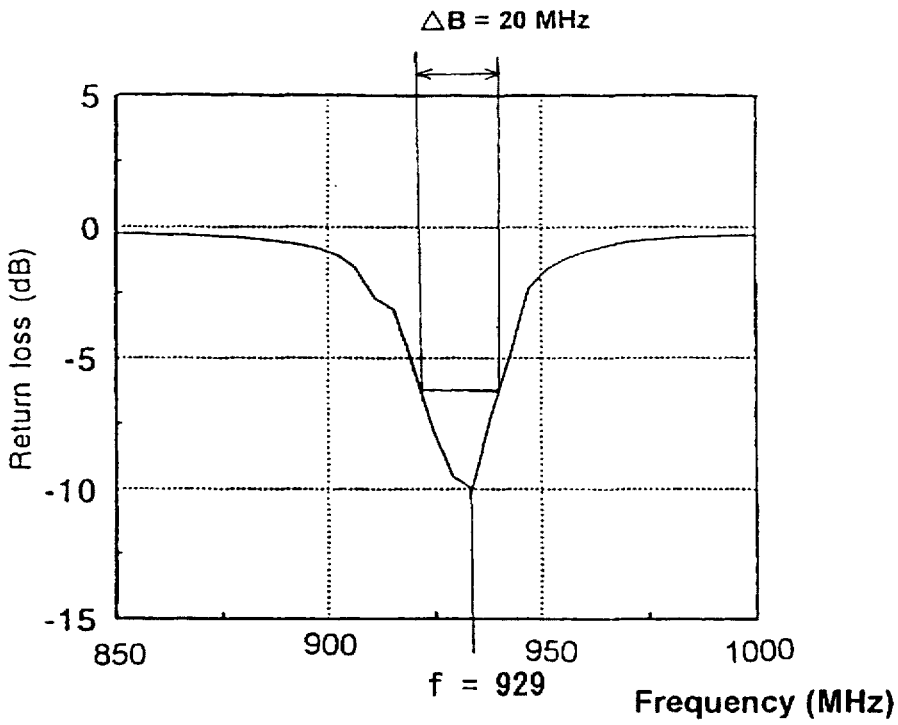
FIG. 4 illustrates the measured return loss of a single patch, in the presence of the remaining three patches of the antenna, in the frequency band of 850 MHz to 1000 MHz.
Figure 5:
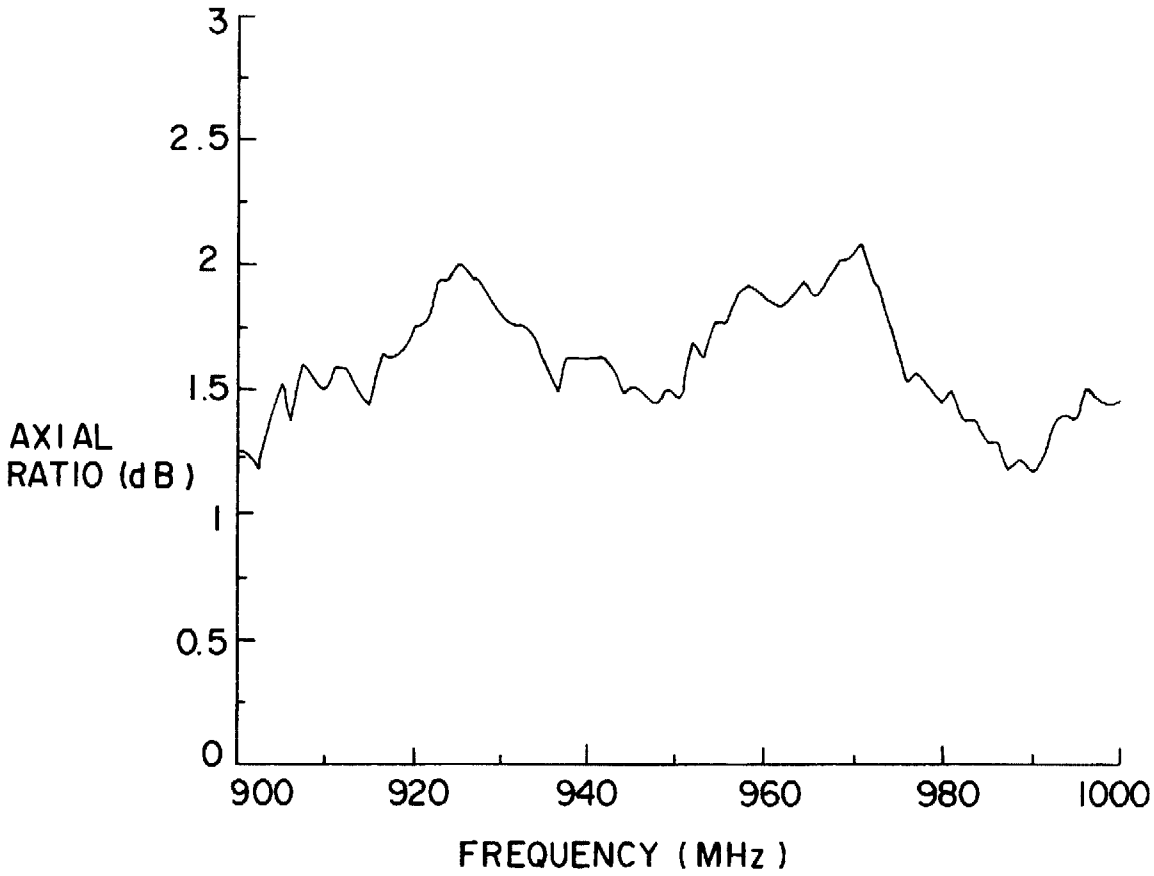
FIG. 5 illustrates the measured axial ratio of the antenna in the frequency band of 900 MHz to 1000 MHz.
Figure 7:
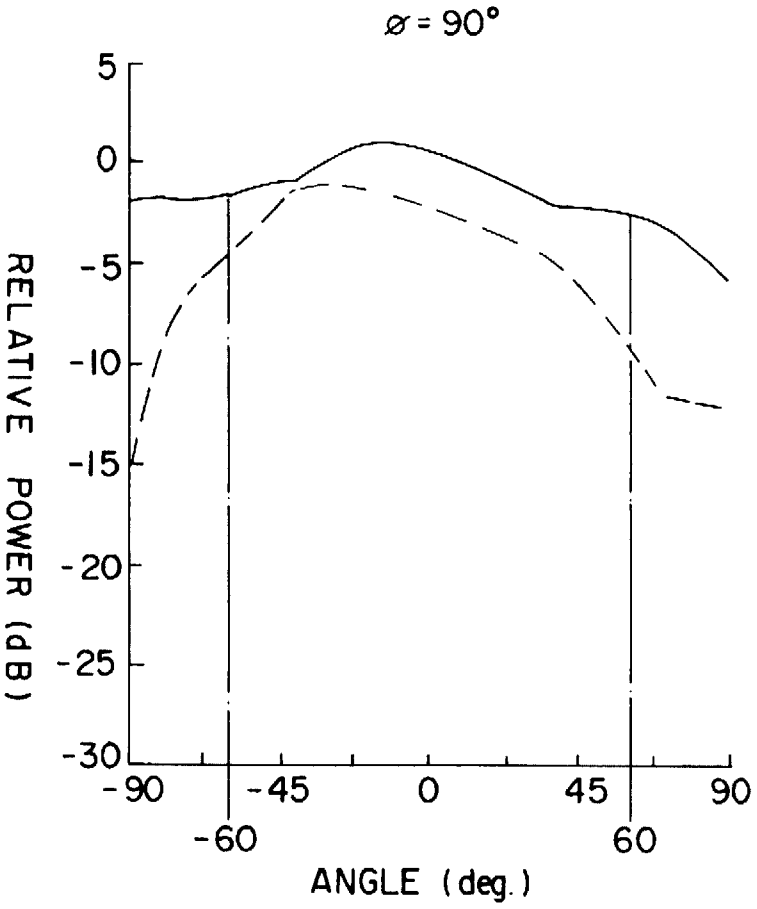
FIG. 7 illustrates a radiation pattern measured at $\phi=90°$ plane of the antenna with the feed of 929 MHz signal in which a solid line [Emax] represents the pattern for the receiving level of the major axis of the polarization ellipse and a dotted line [Emin] represents the pattern for the receiving level of the minor axis of the polarization ellipse.
Figure 6:
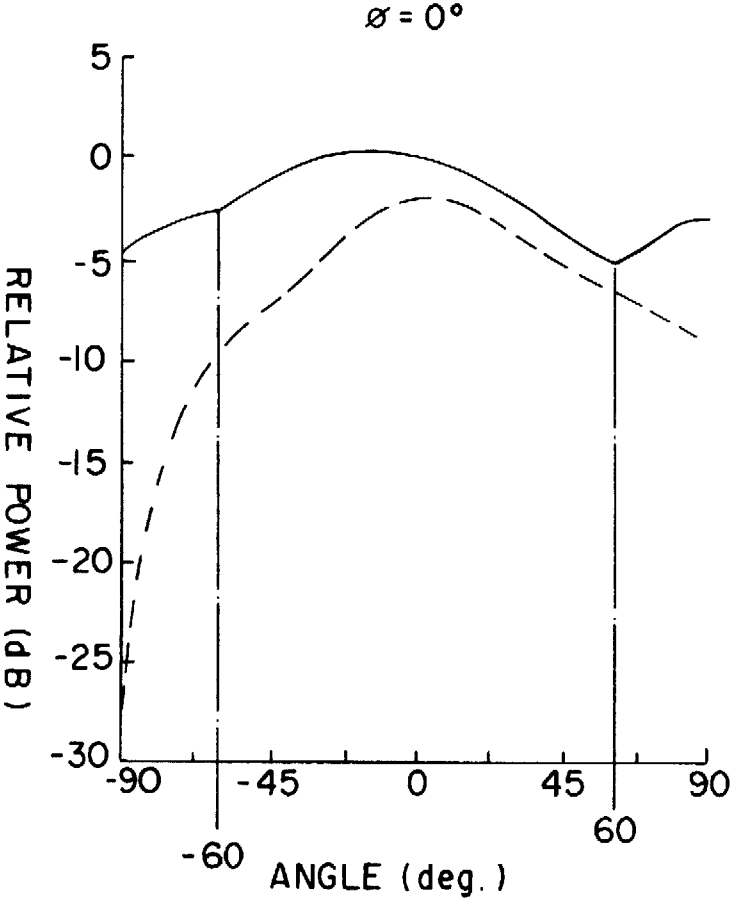
FIG. 6 illustrates a radiation pattern measured at $\phi=0°$ plane of the antenna with the feed of 929 MHz signal in which a solid line [Emax] represents the pattern for the receiving level of the major axis of the polarization ellipse and a dotted line [Emin] represents the pattern for the receiving level of the minor axis of the polarization ellipse.

FIG. 4 shows a return loss of a single patch in the presence of the remaining three patches of the antenna of the first embodiment. FIG. 4 clearly indicates that a resonant frequency of the antenna is 929 MHz. In addition, it is apparent that the return loss of less than −6 dB (VSWR <3) lies over a wide bandwidth ΔB of about 20 MHz and a fractional bandwidth ($=\Delta B/f$, $f$=929 MHz) is as much as 2.15%. FIG. 5 shows an axial ratio measurement of the antenna taken from a band range of 900 MHz to 1000 MHz. From FIG. 5, it is evidenced that good axial ratio of 2.1 or less is assured over a wide bandwidth of the entire range of 900 to 1000 MHz. FIGS. 6 and 7 respectively illustrate radiation patterns of the antenna with the feed of 929 MHz signal at $\phi$=0° plane (H-plane) and $\phi$=90° plane (E-plane). From the radiation patterns, it is evident that the axial ratio is less than a tolerable limit under a wide range of observation angle in both of the H- and E-planes. That is, it is confirmed that the antenna gives an axial ratio (Emax−Emin) of 8 dB or less over an angular range of −60° to +60°, i.e., elevation angle of 30° or more. This assures practically sufficient characteristics between the axial ratio and the elevation angle. Therefore, it should be noted that broad directivity can be achieved not only in E-plane but also in H-plane.

Second Embodiment

Figure 8:
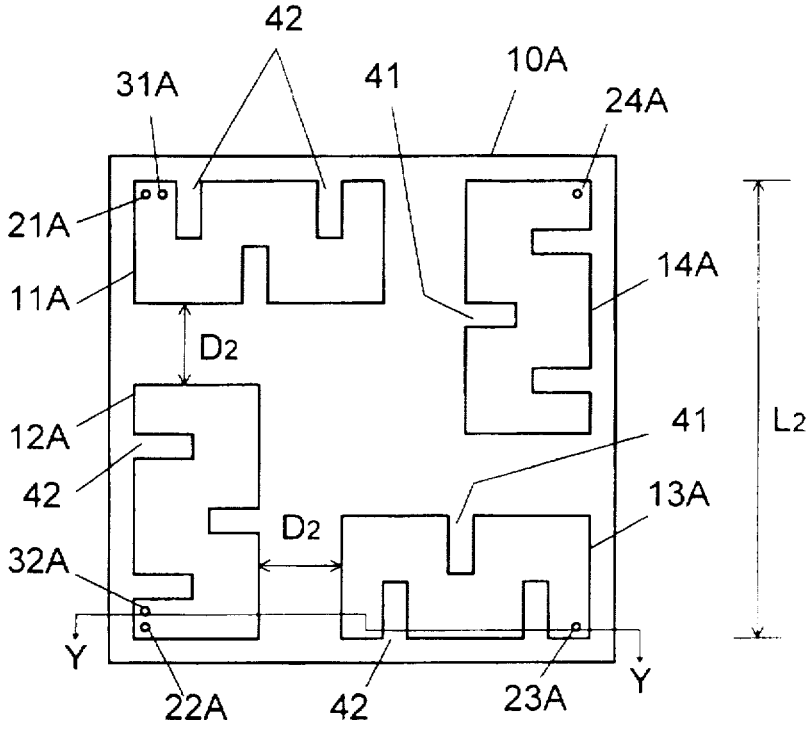
FIG. 8 is a top view of a compact antenna for circular polarization in accordance with a second embodiment of the present invention.
Figure 9:
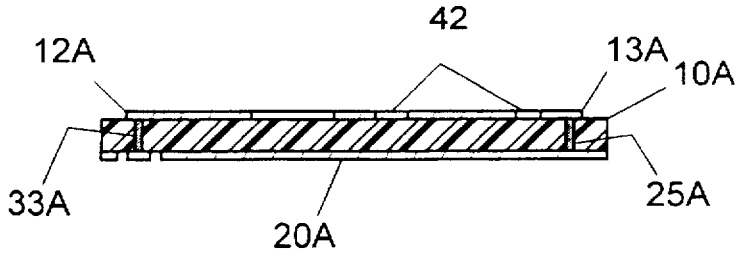
FIG. 9 is a sectional view taken along line Y—Y of FIG. 8.

FIG. 8 illustrates a compact antenna for circular polarization in accordance with a second embodiment. The antenna is basically identical in structure to the antenna of the first embodiment except that four patches having a unique configuration are used. Like parts are designated by like numerals with a suffix letter of "A". Each of the patches is configured to give a meander line along which a signal propagates. A resonant frequency of the antenna can be reduced significantly by using the meander patches. The antenna of the second embodiment is designed for use at an operating frequency of 877.5 MHz and comprises a square substrate 10A of polytetrafluoroethylene resin having a dielectric constant of 2.6, four generally rectangular patches 11A, 12A, 13A, and 14A on a top surface of the substrate 10A, and a ground plane 20A on a bottom surface of the substrate 10A. The substrate 10A measures a 3.2 mm thick and 65 mm×65 mm planar dimension. Each of the patches 11A to 14A is dimensioned to have a 30 mm length and 15 mm width. Each of the patches is formed with a first slit 41 in the center of one lateral side and with two second slits 42 in the opposite lateral sides. Each of the slits is dimensioned to have 7.5 mm length and 2 mm width. The second slits 42 are staggered with respect to the first slit 41 to define a M-shaped meander line, thereby giving an elongated signal line greater than the length of the patch. With this configuration, the patch can be designed to have a reduced apparent length (=30 mm) which corresponds to $\lambda/11.4$ ($\lambda$=wave length of 877.5 MHz signal), while the effective length of the patch is elongated to operate at the intended frequency of 877.5 MHz. Thus, by using of the meander patch, a ratio of the length of the patch relative to the wave length of the resonant frequency, which is $\lambda/11.4$ in the second embodiment, is determined to be shorter than the ratio ($\lambda/10.1$) in the first embodiment. The number of the slits 41 and 42 may be suitably selected for the purpose of changing the effective length of the patch while keeping the apparent length of the patch unchanged. The four patches are defined as a first patch 11A, second patch 12A, third patch 13A, and fourth patch 14A, and are arranged in a square pattern such that a longitudinal axis of the first patch 11A extends parallel to that of the third patch 13A and perpendicularly to that of each of the second patch 12A and fourth patch 14A, and that each of the patches is spaced from the two adjacent patches by a distance D2 of 10 mm. Each of four sides L2 of the square pattern is 55 mm which corresponds to about $\lambda/6$. As shown in FIG. 9, each of the patches is short-circuited by means of a shorting pin 25A having a diameter of 0.5 mm to the ground plane 20A at shorting points 21A, 22A, 23A, and 24A located at the four corners of the square pattern.

A like simplified coplanar 90° phase-shift circuit is formed on the bottom surface of the substrate 10A in a coplanar relation to the ground plane 20A. The phase-shift circuit is connected to only the first and second patches 11A and 12A to define them as active antenna elements and define the third and fourth patches 13A and 14A as parasitic antenna elements. The active antenna elements 11A and 12A are connected to be fed at respective feed points 31A and 32A spaced from the shoring points 21A and 22A by a short distance. A transmitting operation of circular polarization from the antenna of the second embodiment is substantially same as the operation explained in the first embodiment. In addition, it is needless to say that the antenna of the second embodiment can be used to receive circular polarization.

Figure 10:
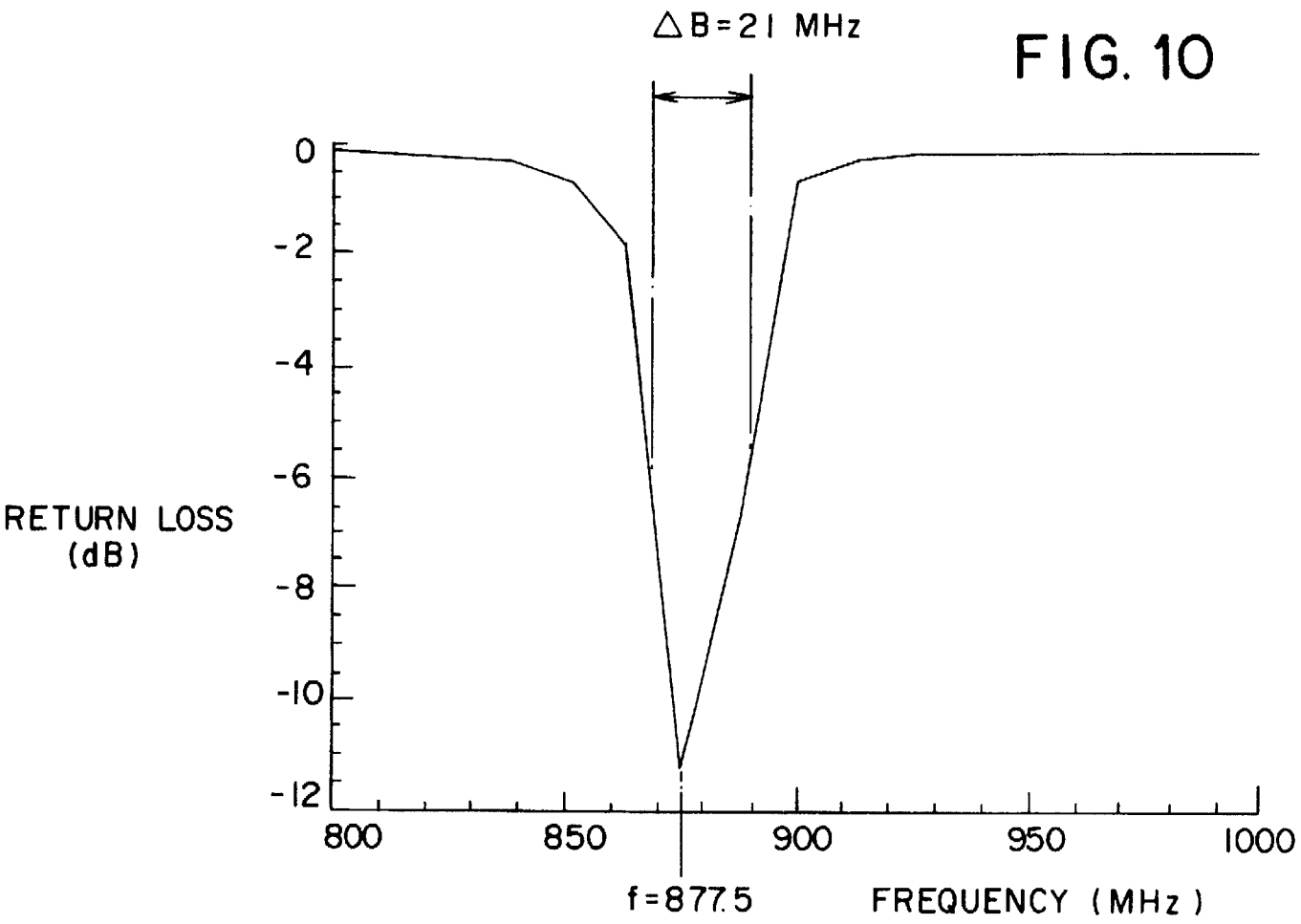
FIG. 10 illustrates the measured return loss of a single patch, in the presence of the remaining three patches of the antenna of FIG. 8, in the frequency band of 850 MHz to 1000 MHz.
Figure 11:
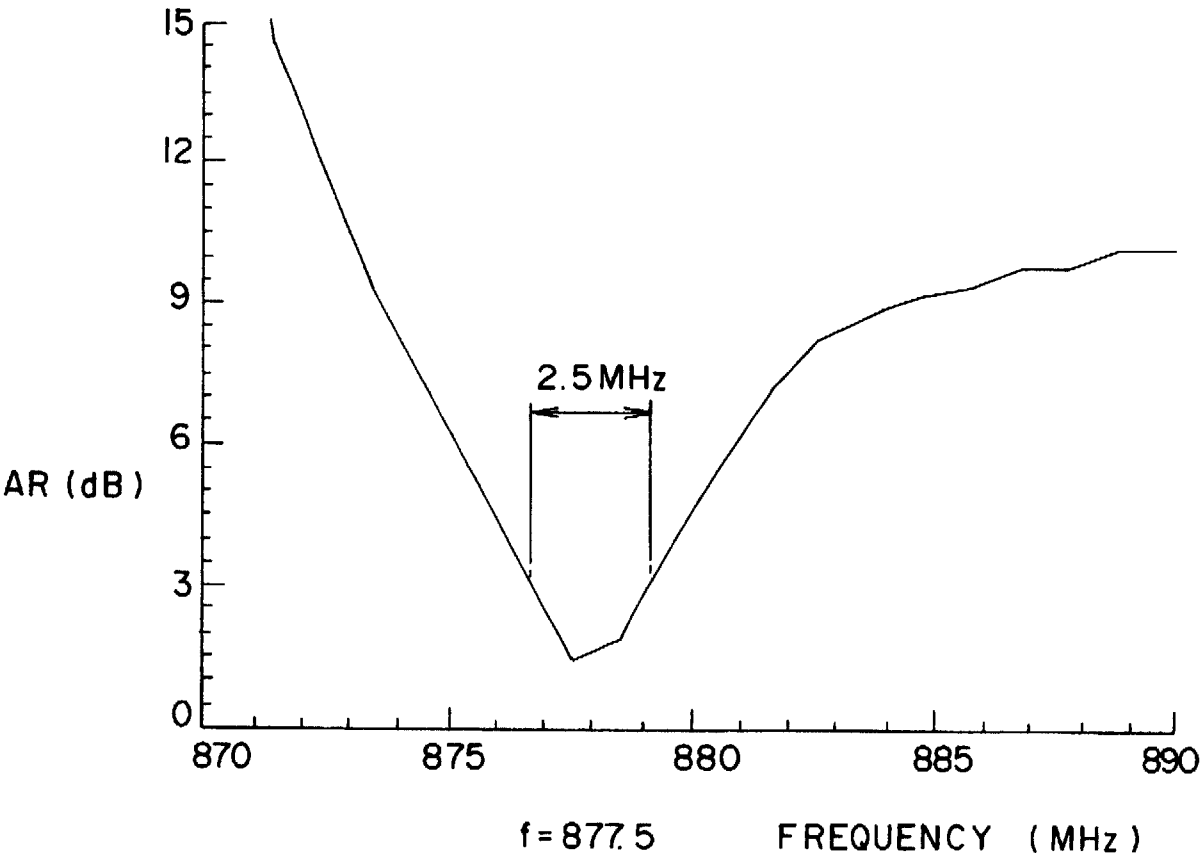
FIG. 11 illustrates the measured axial ratio of the antenna of FIG. 8, in the frequency band of 900 MHz to 1000 MHz.
Figure 12:
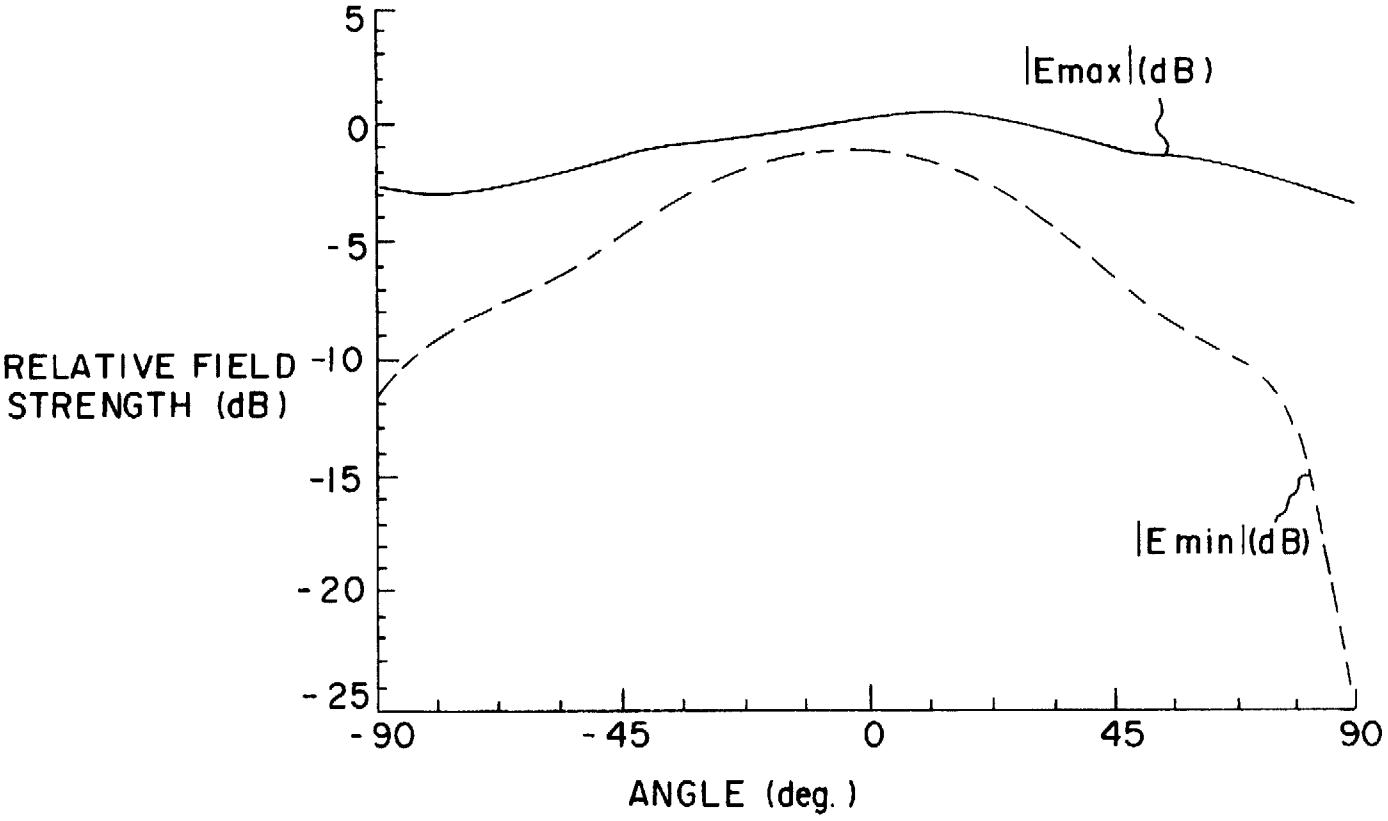
FIG. 12 illustrates a radiation pattern measured at $\phi=0°$ plane of the antenna of FIG. 8 with the feed of 877.5 MHz signal in which a solid line [Emax] represents the pattern for the receiving level of the major axis of the polarization ellipse, and a dotted line [Emin] represents the pattern for the receiving level of the minor axis of the polarization ellipse.
Figure 13:
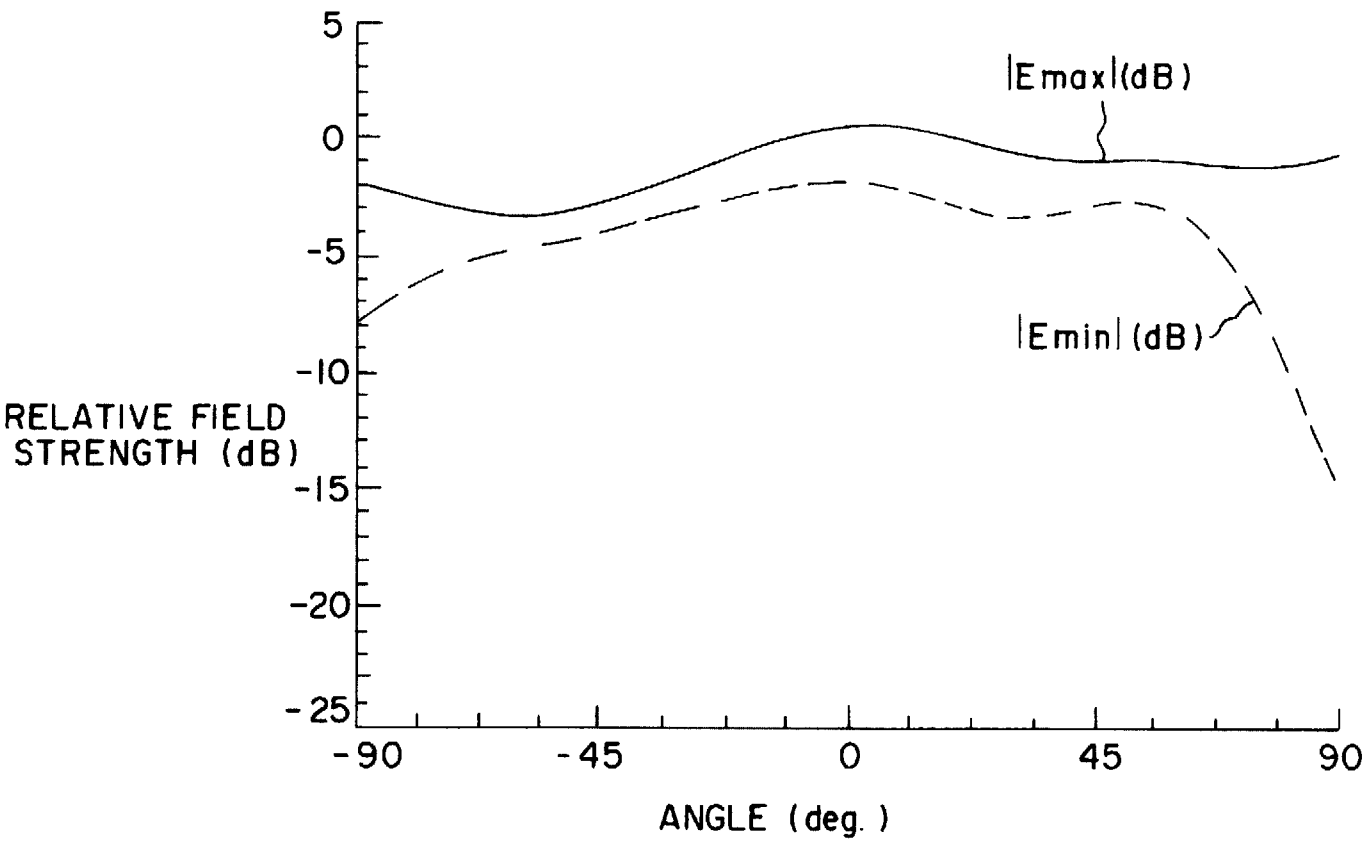
FIG. 13 illustrates a radiation pattern measured at $\phi=90°$ plane of the antenna of FIG. 8 with the feed of 877.5 MHz signal in which a solid line [Emax] represents the pattern for the receiving level of the major axis of the polarization ellipse, and a dotted line [Emin] represents the pattern for the receiving level of the minor axis of the polarization ellipse.

FIG. 10 illustrates a return loss of a single patch in the presence of the remaining three patches of the antenna of the second embodiment. From FIG. 10, it is apparent that the resonant frequency of the antenna is 877.5 MHz. In addition, it demonstrates superior broadband characteristic in that the return loss of less than −6 dB (VSWR <3) is confirmed over a wide bandwidth ΔB of about 21 MHz and a fractional bandwidth (=ΔB/f, f=877.5 MHz) is about 2.39%. An axial ratio of the antenna is illustrated in FIG. 11 in which an acceptable axial ratio of 3 dB or less is assured over a bandwidth of about 2.5 MHz. FIGS. 12 and 13 respectively illustrate radiation patterns of the antenna measured with the feed of 877.5 MHz signal at $\phi=0°$ plane (H-plane) and $\phi+90°$ plane (E-plane). From these radiation patterns, it can be seen that power variations in the E- and H-planes are less than 5 dB over the angular range of −60° to +60°, and the angular range of −45° to +45°, respectively. These results shows good circular polarization performance of the present antenna over a wide angular range in both of the azimuth and elevation planes. Therefore, the present invention would be expected as a compact antenna for transmitting and receiving circular polarization, for example, in a mobile voice and data communication system.

What is claimed is:

1. A compact antenna for circular polarization comprising:

a substrate made of a dielectric material and having a top surface and a bottom surface;

a ground plane on the bottom surface of said substrate;

four planar and rectangular patches made of an electrically conductive material and defined as first, second, third and fourth patches which are mounted in a coplanar relation on the top surface of said substrate, the lengths of said rectangular patches being substantially equal, the widths of said rectangular patches being substantially equal, said four patches being arranged in a square pattern such that a longitudinal axis of said first patch extends parallel to that of said third patch and perpendicularly to that of each of said second and fourth patches, and that each said patch is separated from two adjacent patches by a distance, said square pattern having four sides each of which is equal to the sum of said distance, length and width of said rectangular patch;

shorting means for shorting each of said four patches to said ground plane at a shorting point which is located at a corner of said patch; and feed means for directly feeding only each of said first and second patches at a feed point located near said shorting point, thereby defining said first and second patches as active antenna elements and defining said third and fourth patches as parasitic antenna elements, said feed means comprising a 90° hybrid circuit for providing a first signal to said first patch and providing a second signal which is 90° out of phase with said first signal to said second patch, and two feed lines extending from said 90° hybrid circuit to said feed point of each of said active antenna elements through said substrate without interfering with said parasitic antenna elements, said parasitic antenna elements being electromagnetically excited by said active antenna elements fed with said first and second signals to develop third and fourth signals which are cooperative with said first and second signals to achieve circular polarization, said third patch providing said third signal which is 180° out of phase with said first signal, said fourth patch providing said fourth signal which is 270° out of phase with said first signal, all of said first, second, third and fourth patches operating at a single resonance frequency for transmitting a circular polarization wave.

2. The compact antenna as set forth in claim 1 wherein said shorting points of said four patches are located at four corners of said square pattern.

3. The compact antenna as set forth in claim 1, wherein said patches and said ground plane are made respectively by etching conductive layers on opposite surfaces of said substrate.

4. The compact antenna as set forth in claim 1, wherein said hybrid circuit is a simplified coplanar 90° phase-shift circuit which is formed on said bottom surface of said substrate, said phase-shift circuit comprising first and second strip lines extending from a common feed terminal on said bottom surface in a coplanar relation to said ground plane, respectively to first and second feed terminals on said bottom surface of said substrate below said active antenna elements, said first and second feed terminals being connected to respectively said feed points on said active antenna elements through said feed lines, said first strip line having a length differing from that of said second strip line by an amount to provide a 90° phase difference between signals propagating in said two active antenna elements.

5. The compact antenna as set forth in claim 1, wherein at least one slit is formed in at least one of two opposed sides of each said patch so as to define a meander line in each patch.

6. The compact antenna as set forth in claim 5, wherein each said patch has one slit in one side and two additional slits in another side, said two additional slits being staggered with respect to said one slit.

7. The compact antenna as set forth in claim 1, wherein the length of each of said patches is less than a quarter of wavelength of a resonant frequency of said antenna.

* * * * *